US006922871B2

(12) United States Patent
Holman et al.

(10) Patent No.: US 6,922,871 B2
(45) Date of Patent: Aug. 2, 2005

(54) ARTICULATING GLIDE MECHANISM FOR ASYMMETRIC DOOR OPERATION

(75) Inventors: Wrenn P. Holman, Marietta, GA (US); Chad L. Braunschweig, Sumner, WA (US); Robert W. Dost, Kent, WA (US); Paul J. Wright, Redmond, WA (US); James G. Hutton, deceased, late of Kirkland, WA (US); by Jan Hutton, legal representative, Kirkland, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/329,316

(22) Filed: Dec. 23, 2002

(65) Prior Publication Data

US 2004/0117944 A1 Jun. 24, 2004

(51) Int. Cl.[7] ..... A47H 15/00
(52) U.S. Cl. ..... 16/197
(58) Field of Search ..... 16/87 R, 97, 105–107, 16/102, 104, 91, 98, DIG. 31; 49/404, 424, 332, 420, 423, 409, 425; 160/323.1, 903; 105/150, 153, 96; 295/1

(56) References Cited

U.S. PATENT DOCUMENTS 521,225 A * 6/1894 Trimble ..... 16/87 R
839,620 A * 12/1906 Myers ..... 16/105
2,944,282 A * 7/1960 Greco ..... 16/87 R
2,982,988 A * 5/1961 Blackmer ..... 16/97
3,072,169 A * 1/1963 Hastings, Jr ..... 152/41
3,361,489 A * 1/1968 Gionet ..... 384/19
3,874,748 A * 4/1975 Figueroa ..... 384/19
3,971,601 A * 7/1976 Sytsma ..... 384/492
4,064,593 A * 12/1977 Helmick ..... 16/105
5,845,363 A * 12/1998 Brempell et al. ..... 16/105

* cited by examiner

*Primary Examiner*—Robert J. Sandy
*Assistant Examiner*—Andre' L. Jackson
(74) *Attorney, Agent, or Firm*—Black Lowe & Graham PLLC

(57) ABSTRACT

The present invention includes an apparatus for guiding movement of an object along a track. The apparatus includes an attachment member defining an opening. A bushing is positioned in the opening and the bushing is laterally moveable within the opening. A plunger is attached to the bushing and the plunger is configured to move towards and away from the bushing. A guide mechanism is pivotably attached to the plunger and the guide mechanism is moveable along the track. According to other aspects of the invention, a slider is used in combination with a roller as the guide mechanism.

20 Claims, 10 Drawing Sheets

ARTICULATING GLIDE MECHANISM FOR ASYMMETRIC DOOR OPERATION

FIELD OF THE INVENTION

This invention relates generally to glide mechanisms and, more specifically, to a system and method for guiding track-mounted doors.

BACKGROUND OF THE INVENTION

Equipment and facilities often have track-mounted doors. In specialized equipment and facilities, doorway tracks may not be straight, may fold away, or may have gaps. Asymmetrical movement or loading may cause such track-mounted doors to bind or jam. Historically, track-mounted doors run on rollers. In more complicated applications pairs of rollers that may be mounted on pivots are sometimes utilized. However, doors with tab or ear mounted guides or rollers may be subject to binding or jamming when the door or other object being translated along the track is forced into a skew position relative to the tracks.

In special applications, tracks for doorways sometimes fold away or are segmented. These tracks may have gaps that door guide mechanisms must cross. Such track gaps create additional conditions where asymmetric loading or movement of the door or object being translated may cause binding or jamming. Aircraft often utilize complex doorway tracks for access doors. These doors are latched to the fuselage when closed, but must move into the aircraft when opened. The doorway tracks are sometimes folded away for access to equipment in the aircraft being serviced. Asymmetric loadings by hand operation of access doors can cause binding or jamming of the door mechanisms.

FIG. 1A is an isometric view of an example electronic/equipment bay 5 of an aircraft (not shown). A door 10 rides on fixed tracks 9 that are attached to an aircraft's fuselage, and rides on folding tracks 8 within the aircraft as the door 10 is opened and lifted within the aircraft. The folding tracks 8 in this embodiment are integrated into folding track supports 7, which pivot out of the way after the door 10 has been translated along the tracks, and opened thereby providing access to electronic and electrical equipment in the bay 5. In the prior art example shown in FIG. 1A, the door 10 rides along the fixed tracks 9 and the moveable tracks 8 utilizing three sets of dual rollers 12. These dual rollers 12 include a linked pair of wheels on a rotating mount (not shown). The mount can rotate allowing the pair of wheels to follow curved tracks, and aids the wheels in bridging gaps in the track. The folding track supports 7 can introduce a small gap between the moveable tracks 8 and the fixed tracks 9. The door 10 is unlatched and lifted along the fixed tracks 9, across gaps in the track (not shown), and up and out of the way to the side along the movable tracks 8 on the folding track supports 7. This permits maintenance access to the equipment in the bay 5. It will be appreciated that hand opening of the door 10 can place asymmetrical loads and movement on the door 10 causing the door 10 to jam.

Therefore, a need exists for a glide mechanism for door operation, and for translating other objects along tracks, that is more jam and binding resistant than current systems.

SUMMARY OF THE INVENTION

The present invention includes an apparatus for guiding movement of an object along a track. The present invention permits objects such as doors to be moved along tracks even when asymmetric loads and orientations of the object or door occur as they are moved along the track. Loads and orientations are accommodated thereby permitting the door or object to consistently glide along its track.

In one exemplary embodiment, the apparatus includes an attachment member that defines an opening. A bushing is positioned in the opening and the bushing is laterally moveable within the opening. A plunger is attached to the bushing and the plunger is configured to move towards and away from the bushing. A guide mechanism is pivotably attached to the plunger and the guide mechanism is moveable along the track.

The present invention provides a jam-resistant articulating apparatus and system for guiding objects along tracks. In an aspect of the invention, the guide mechanism includes a slider to assist the guide mechanism in following curved track and bridging track gaps, especially in applications where there are folding tracks, such as in an aircraft equipment bay door.

BRIEF DESCRIPTION OF THE DRAWINGS

The preferred and alternative embodiments of the present invention are described in detail below with reference to the following drawings.

DETAILED DESCRIPTION OF THE INVENTION

By way of overview, the present invention includes an apparatus for guiding movement of an object along a track. An exemplary embodiment of the apparatus includes an attachment member that defines an opening. A bushing is positioned in the opening and the bushing is laterally moveable within the opening. A plunger is attached to the bushing and the plunger is configured to move towards and away from the bushing. A guide mechanism is pivotably attached to the plunger and the guide mechanism is moveable along the track.

The present invention thus permits objects such as doors to be moved along tracks, even when asymmetric loads and orientations of the object or door occur as it is moved along the track. Loads and orientations are accommodated permitting the door or object to consistently glide along its track.

Figures 1A, 1B:
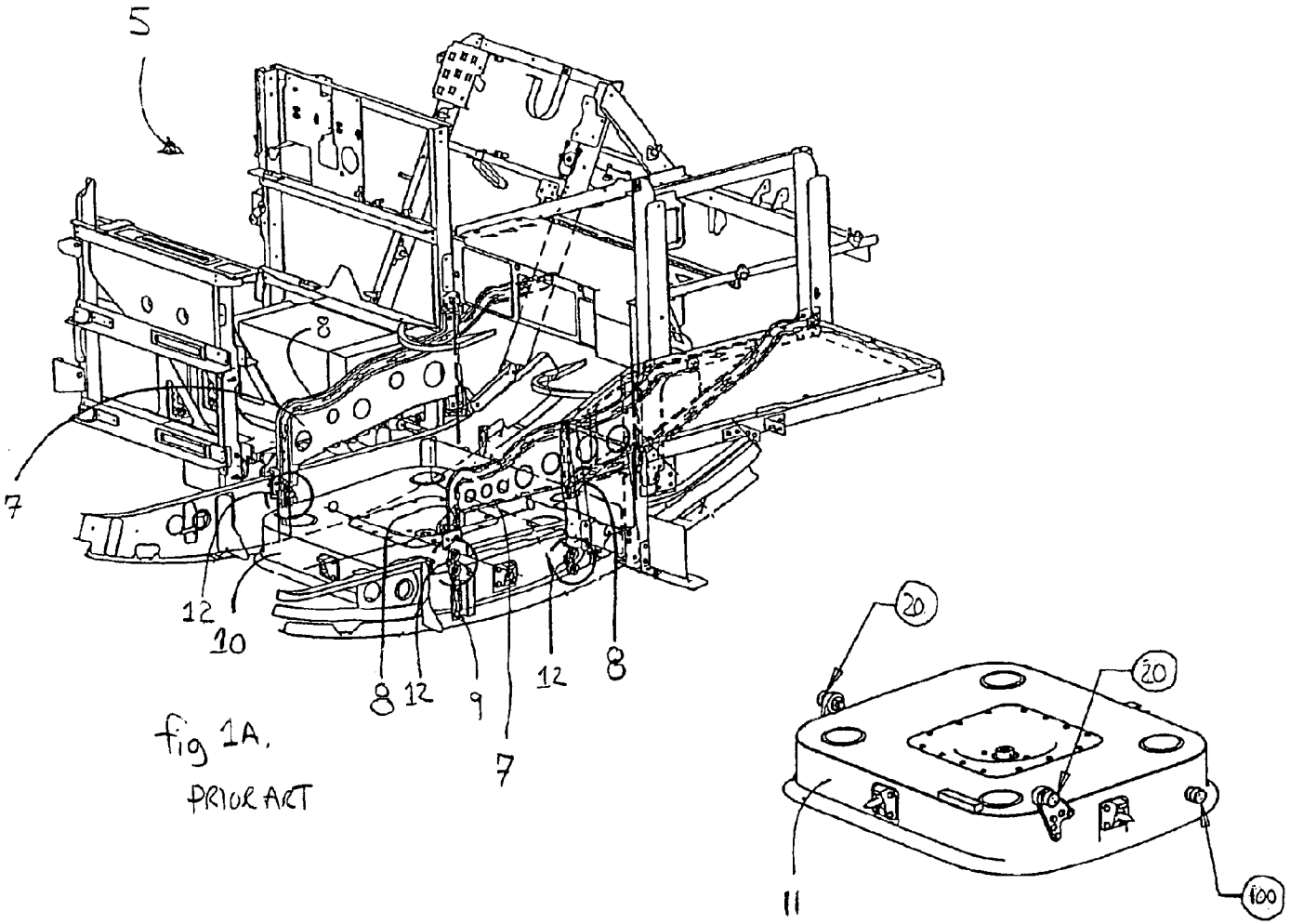
fig. 1A. PRIOR ART
FIG. 1A is an isometric drawing of an electronic/equipment bay of an aircraft showing a prior art door guide mechanism.
FIG. 1B is an isometric drawing of an electronic/equipment bay door of an aircraft equipped with an articulating glide mechanism of the present invention.

FIG. 1B shows an equipment bay door 11. The door 11 is similar to the door 10 (FIG. A). However, the door 11 two ear-mounted guides 20 and one pedestal roller 100, as opposed to three sets of dual rollers 12 of the prior art door 10 (FIG. 1A). The two ear-mounted guides 20 and one pedestal roller 100 project out from the door 11 to mate with the door tracks (not shown). It will be appreciated that any suitable number and suitable mounting of ear-mounted guides 20 and pedestal rollers 100 may be used for a desired application.

Figure 2A:
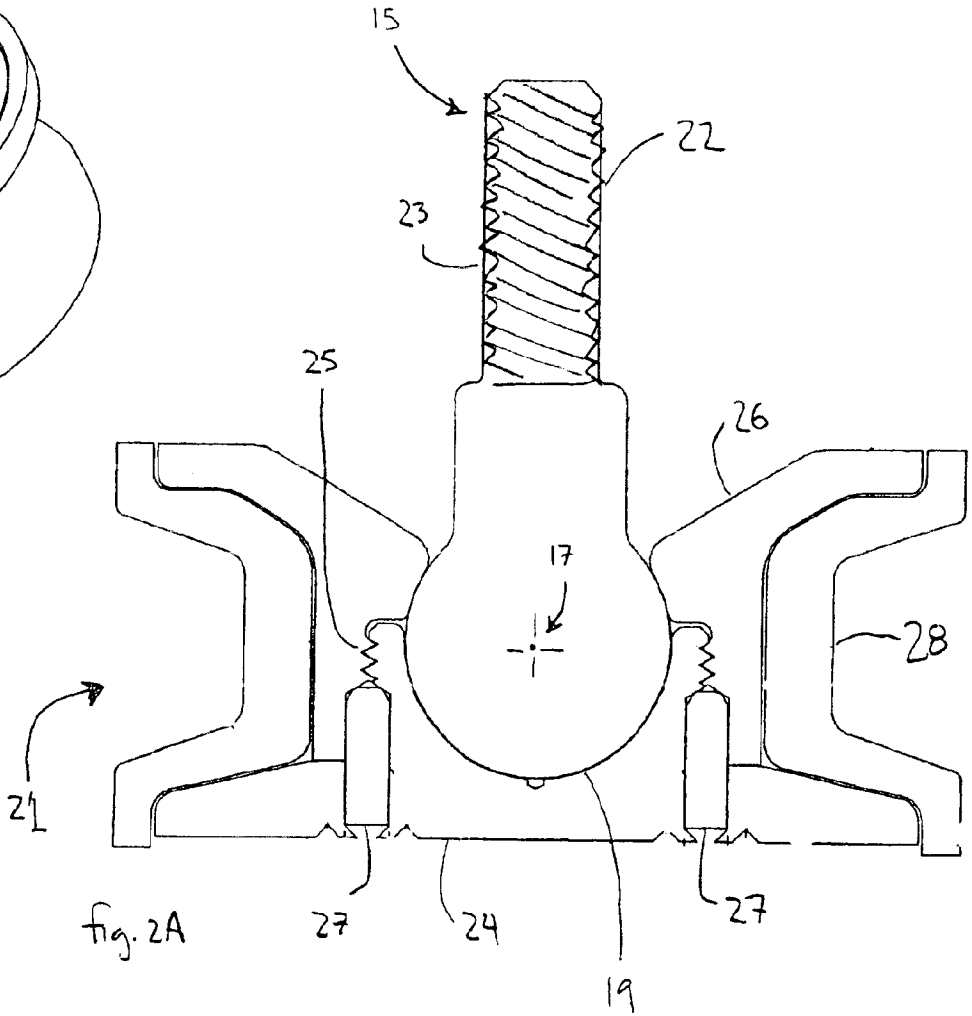
FIG. 2A is a cross-section of an exemplary pivoting wheel of the present invention.

FIG. 2A is a cross-section of an exemplary pivoting wheel guide 21 of the present invention. The wheel guide 21 allows the wheel 28 to pivot, accommodating asymmetric orientations and loads without jamming the wheel 28 against the track (not shown). The wheel guide 21 includes a wheel 28 that pivots on a female bearing housing 26 and a male bearing housing 24 that are threaded together with threads 25 and are prevented from unthreading using lock pins 27. The wheel 28 is suitably shaped to mate with the track (not shown). The female bearing housing 26 and the male bearing housing 24 suitably clamp to the wheel 28. It will be appreciated that the wheel 28 also suitably spins freely on the female bearing housing 26 and male bearing housing 24, with or without additional bearings such as ball bearings or roller bearings. The female bearing housing 26 and male bearing housing 24 also surround and lock over a spherical pin 22 thereby permitting the wheel 28 to pivot side to side and to spin around the spherical pin 22.

The spherical pin 22 has a spherical end 19. The female bearing housing 26 and male bearing housing 24 are suitably spherically hollow and surround the spherical end 19, thus permitting the wheel 28 to pivot and spin around a pivot point 17. The female bearing housing 26 and male bearing housing 24 are suitably shaped such that when threaded together they retain the spherical end 19 of the pin 22, while still allowing pivoting and spinning of the wheel 28. It will be appreciated that the pin 22 and the female bearing housing 26 and male bearing housing 24 may suitably have corresponding shapes other than spherical shapes that permit the wheel 28 to move and pivot in directions as determined by the track and loading configurations where the present invention is utilized. The other end of the spherical pin 22 is a connection end 15, with threads 23 that permit the pin 22 to be attached to, by way of example, the plunger (not shown).

It will be appreciated that the wheel 28, the bearings housings 24 and 26, and the spherical pin 22 may be constructed of any suitable materials as desired to support the object or door being translated along a track. In an exemplary embodiment, the wheel 28 is a segment of glass fiber-filled rod machined to a suitable shape to fit within the male bearing housing 24 and the female bearing housing 26, which are fastened, together through the center of the wheel 28. The wheel 28 is suitably shaped to mate with the track (not shown) including by way of example but not limitation being notched around its perimeter. In an exemplary embodiment, the male bearing housing 24 and the female bearing housing 26 are made of a copper beryllium alloy. The pins 27 that lock the male bearing housing 24 to the female bearing housing 26 may be made of any suitable material. In an exemplary embodiment, the pins 27 are stainless steel and are held in place by bent-over portions of the male bearing housing 24. In an exemplary embodiment, the spherical pin 22 is stainless steel with threads 23 for attachment to the balance of the guide mechanism (not shown). It will be appreciated that any suitable pin, housing, attachment and wheel configuration or combination, which permits the wheel 28 to pivot from side to side and spin, may be utilized.

Figure 2B:
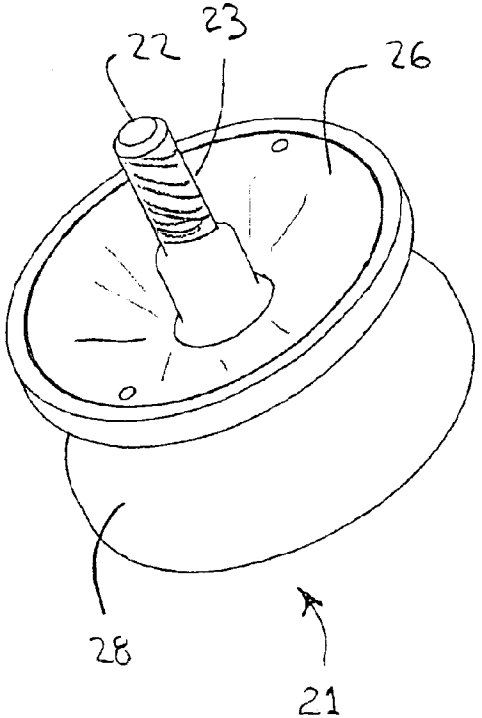
FIG. 2B is an isometric drawing of an exemplary pivoting wheel of the present invention.

FIG. 2B is an isometric drawing of the assembled wheel 28, female bearing housing 26, and spherical pin 22. The threads 23 of the spherical pin 22 extend away from the wheel 28, thereby permitting the wheel to be attached to the balance of the guide mechanism and yet still spin and pivot from side to side. The female bearing housing 26 is suitably hollowed to increase clearance as the wheel 28 pivots with respect to the pin 22.

FIGS. 3A, 3B, 3C and 3D are differing views of a support ear 30 for the ear-mounted guides 20 of the present invention.

Figure 3B:
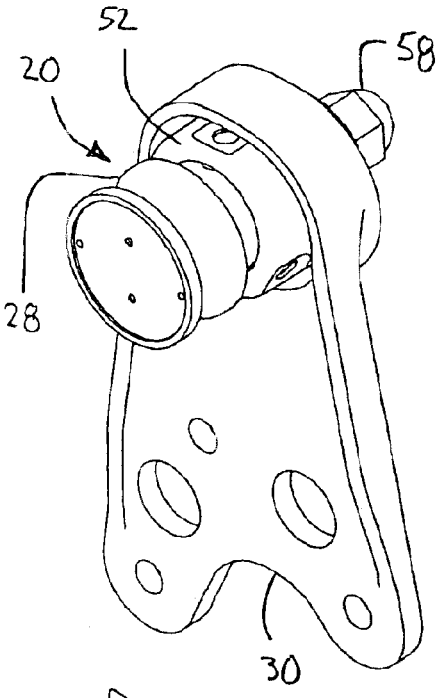
FIG. 3B is an isometric drawing of an example support ear with the glide mechanism of the present invention installed.
Figure 3C:
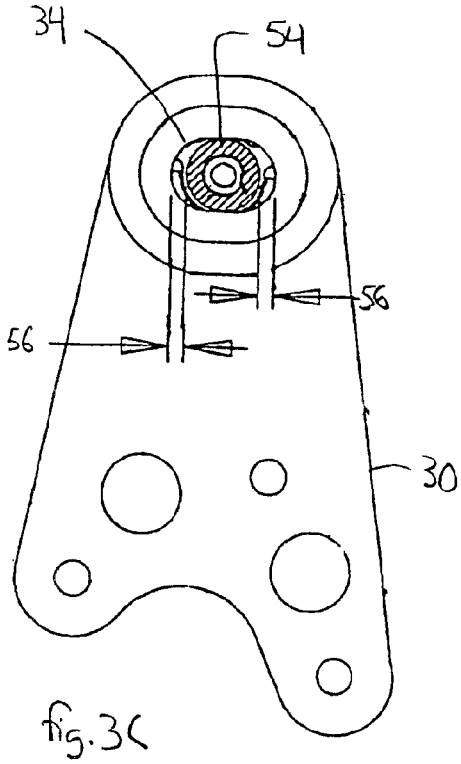
FIG. 3C is a front view of an example support ear of the present invention.
Figure 3A:
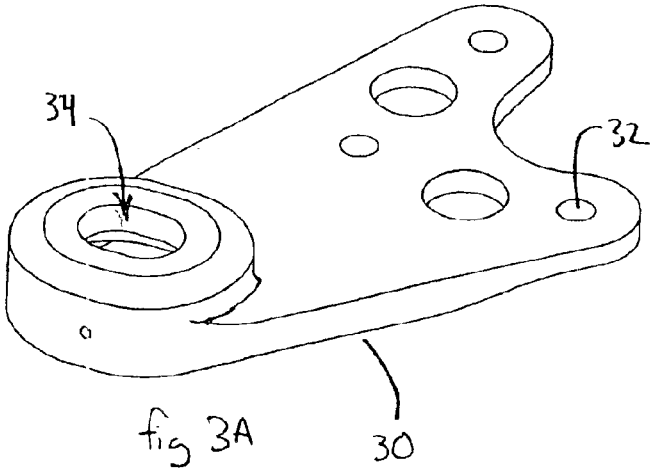
FIG. 3A is an isometric drawing of an example support ear for the glide mechanism of the present invention.

In FIG. 3A, the ear 30 has mounting holes 32 for mounting to the door (not shown). The ear 30 further defines an elongated slider opening 34. As described further below, the elongated slider opening 34 is suitably shaped to allow the guides of the present invention to move laterally to follow their guide tracks.

FIG. 3B shows the ear 30 with an ear-mounted guide 20 installed. The guide 20 includes a wheel 28 and a truck 52 that is mounted to the ear 30 with a threaded pin (not shown) and held in place by a cap nut 58.

FIG. 3C is a front view of the ear 30 showing the elongated opening 34 that allows the guide of the present invention to move laterally and thereby follow the guide tracks for the door (not shown). The guide (not shown) is held in the opening 34 by a cylindrical slider bushing 54 that can slide back and forth laterally within the opening 34. The opening 34 is advantageously longer than the diameter of the slider bushing 54 thereby resulting in lateral clearance that permits the bushing and the attached guide mechanism (not shown) to move laterally. It will be appreciated that the ear 30 and slider bushing 54 may be made of any materials suitable to hold the guide mechanism and to allow it to slide laterally in the opening 34. In an exemplary embodiment, the ear 30 is suitably made of 15-5PH Cres Steel and the slider bushing 54 is suitably made of a copper beryllium alloy.

Figure 3D:
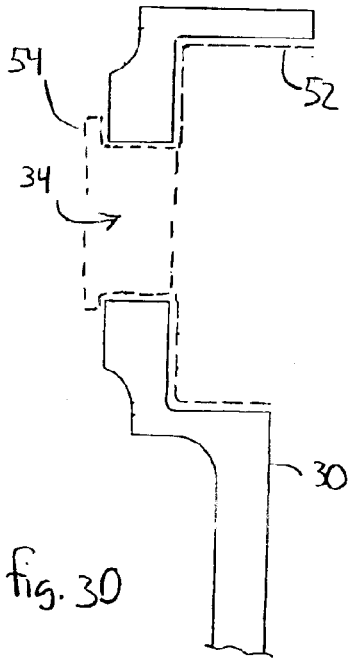
FIG. 3D is a cross-section of an example support ear of the present invention.

FIG. 3D is a cross-section of the ear 30 showing the slider bushing 54 (in phantom) within the opening 34. The slider bushing 54 is attached to the truck 52 (shown in phantom) that forms a part of the guide mechanism (not shown). The slider bushing 54 is suitably attached to the truck 52 through the opening 34 in the ear 30 such that the truck 52 and bushing 54 are held by the ear 30, but may still move laterally (towards and away from the viewer in this FIG. 3D).

Figure 4:
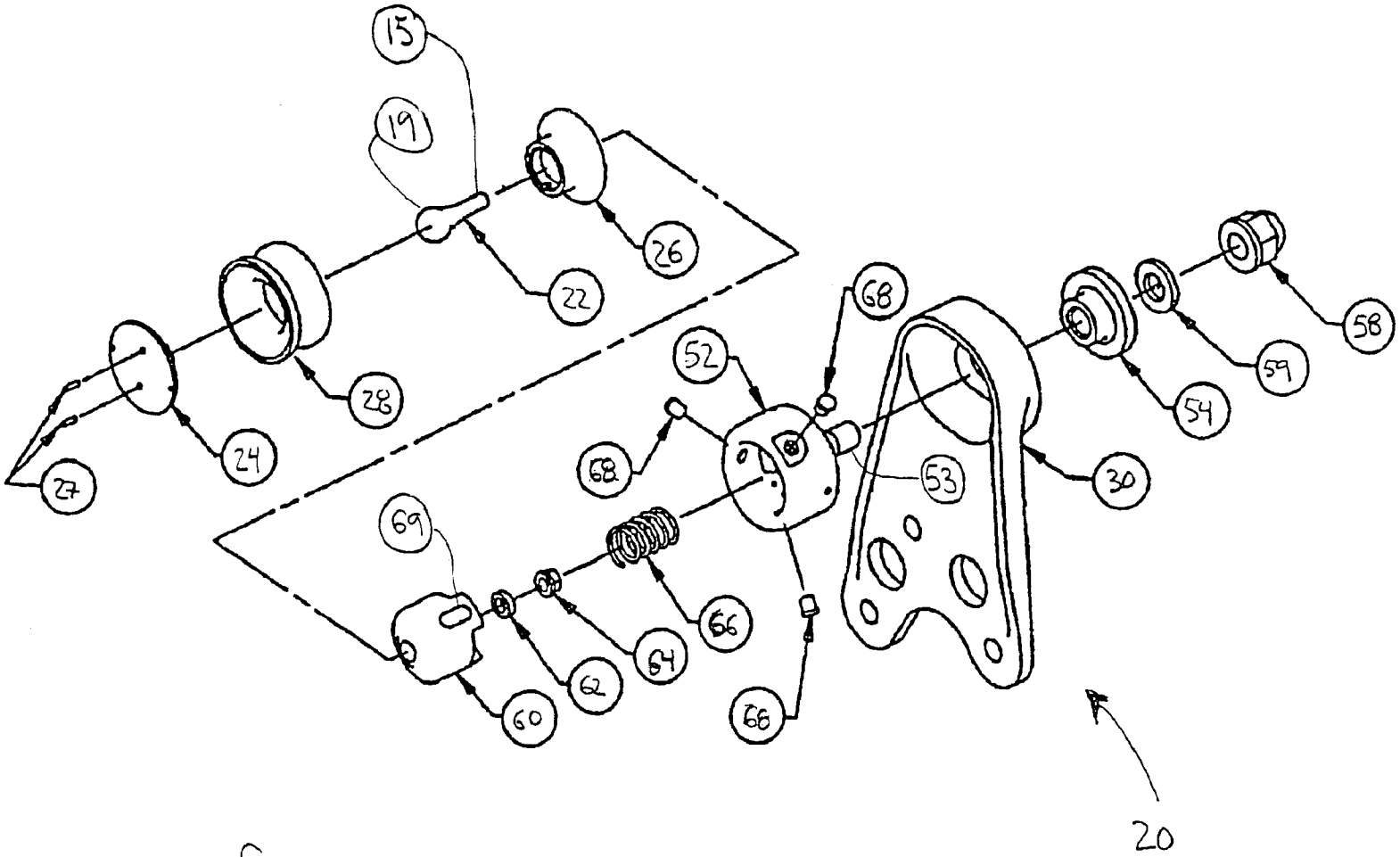
FIG. 4 is an exploded view of an example roller guide mechanism of the present invention.

FIG. 4 is an exploded view of an exemplary embodiment of an ear-mounted guide 20 of the present invention. The wheel 28 is held between the male bearing housing 24 and the female bearing housing 26 that are screwed together and locked by the locking pins 27. This holds the wheel 28 on the rounded spherical end 19 of the spherical pin 22. In turn, the connection end 15 of the spherical pin 22 is mounted to a plunger 60. The plunger 60 permits in and out movement of the wheel 28 towards and away from the guide track (not shown). In this embodiment, the spherical pin 22 is threaded through the plunger 60 and is held in place by a pin washer 62 and a pin nut 64 that mates with the threads 23 on the connection end 15 of the spherical pin 22. The plunger 60 is suitably rounded or cone shaped to increase pivoting clearance for the wheel 28.

The plunger 60 is spring-loaded by a spring 66 within a truck 52. The spring 66 biases the plunger 60 in an extended position towards the track (not shown). The plunger 60 nests within the truck 52 thereby allowing the plunger 60 to slide in and out from the truck 52. Moving the plunger 60 in and out facilitates moving the attached wheel 28 along the track (not shown) when the door or object being guided (not shown) is asymmetrically loaded or skewed with respect to the track (not shown). The plunger 60 moves in and out to accommodate changing distances between the track (not shown) and door (not shown) at the position of the guide 20. In this exemplary embodiment, the plunger 60 is retained within the truck 52 by three retainer pins 68. The three retainer pins 68 are spaced at approximately 120° radially around the truck 52 and extend into slots 69 in the plunger 60. The slots 69 allow the plunger 60 to move in and out of the truck 52 but not work itself free. In this embodiment, the retainer pins 68 are threaded into the truck 52. In an example embodiment, the plunger is made from a copper beryllium alloy, while the truck 52 and retaining pins 68 are made from stainless steel. However, any suitable material may be utilized for the plunger 60, truck 52 and retainer pins 68.

In turn, the truck 52 fits into the support ear 30 that attaches the guide 20 to the door or object being moved along the track (not shown). The truck 52 is attached to and held in place by the slider bushing 54. This allows the guide 20 to slide laterally within the ear 30. The truck has a threaded projection 53 that projects through the slider bushing 54 and is retained by a truck washer 59 and a cap nut 58. It will be appreciated that any suitable means and configurations that permit the wheel 28 to rotate and pivot while plunging in and out towards and away from the track, as well as move laterally to stay aligned with the track, may be utilized by the present invention. The mechanism of the guide 20 is thus suitably not limited to the components shown in FIG. 4. By way of example and not limitation, the slider bushing 54 is suitably a linear slider, instead of a cylindrical bushing. The plunger 60 need not fit within the truck 52, but may mesh with it, or the truck 52 may alternately fit within a larger plunger 60. The plunger 60 may suitably be unsprung or in other words left unbiased. The plunger 60 suitably may also be biased in, out, or centered, with an alternative mechanism or flexible material instead of a spring. The ear 30, truck 52, and pin 22 need not be held with nuts, but may be held in place with pins or other attachment or locking mechanisms.

Figure 5:
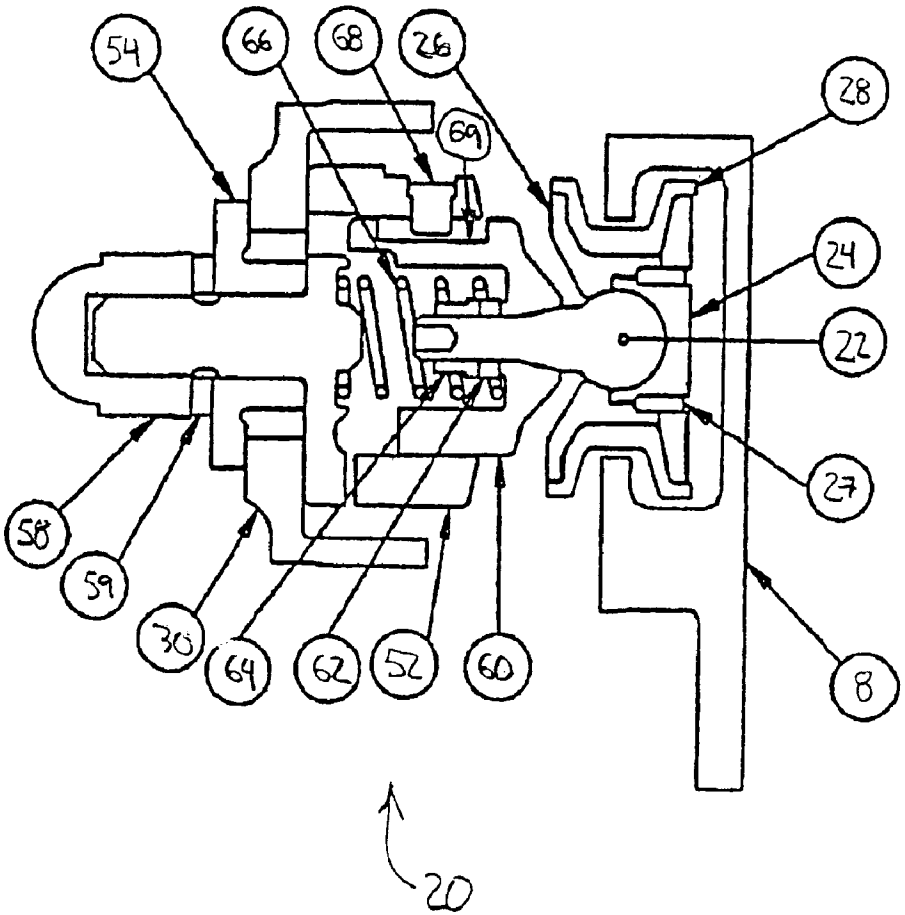
FIG. 5 is a cross-section of an example roller guide of the present invention.

FIG. 5 is a cross-section of an example guide 20 of the present invention. The guide 20 rides on a track 8 with a wheel 28. The wheel 28 is held by the male housing bushing 24 and the female housing bushing 26 on the spherical-ended pin 22. The male housing bushing 24 and the female housing bushing 26 are threaded together and locked together with locking pins 27. In turn, the pin 22 is attached to the plunger 60 and held in place with a pin washer 62 and a pin nut 64. The plunger 60 is conically shaped where it abuts the female housing bushing 26 and is cylindrically shaped where it fits within the truck 52. It will be appreciated that in this embodiment the conical shape of the plunger 60 forms a steeper cone than a corresponding hollow in the female bearing housing 26 that holds the wheel 28. This provides clearance for the wheel 28 to pivot around the spherically-ended pin 22 and not bind against the plunger 60 while still permitting the wheel 28 to spin.

In this embodiment, the plunger 60 is held within the truck 52 by retaining pins 68 threaded through the truck 52 and projecting into a slot 69 in the plunger 60, thereby allowing the plunger 60 to move in and out from the truck 52 but not become free. The plunger 60 is suitably spring-loaded with respect to the truck 52 by a spring such as without limitation a music wire spring 66. In turn, the truck is attached to the slider bushing 54 with a truck washer 59 and cap nut 58. This holds the slider bushing 54 against the truck 52 while still allowing the slider bushing 54 and the attached guide 20 to slide laterally within the support ear 30 (also shown in cross-section).

Figure 6A:
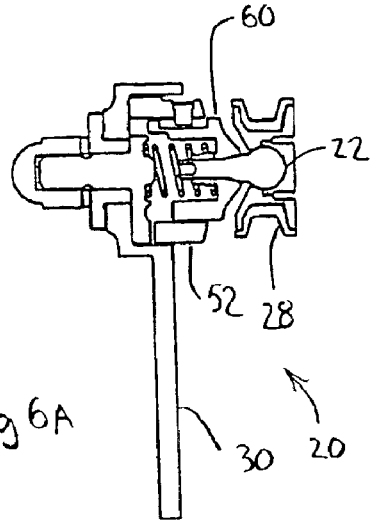
FIG. 6A is a cross-section of an example roller guide of the present invention in its center position.

FIGS. 6A, 6B, 6C and 6D show the operation of the guide 20 of the present invention. In FIG. 6A, the wheel 28 is held on the spherically-ended pin 22. The pin 22 is attached to a plunger 60 held within a truck 52 that slides laterally within the support ear 30. In FIG. 6A, the plunger 60 is shown in its intermediate position within the truck 52. In this example, the plunger 60 is midway within its travel range.

Figure 6B:
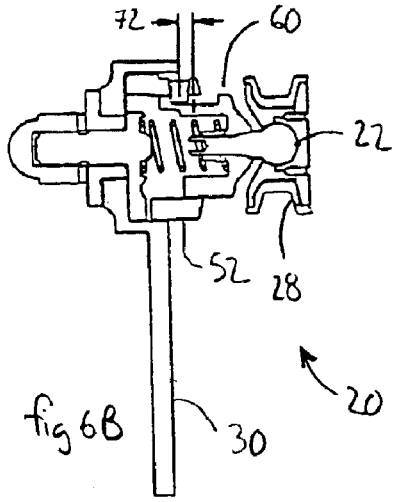
FIG. 6B is a cross-section of an example roller guide of the present invention in its extended position.

FIG. 6B shows the plunger 60 in its extended position with respect to the truck 52 with the plunger 60 extended outward. This moves the wheel 28 away from the support ear 30 an outward plunger clearance distance 72. This allows the wheel 28 to follow the guide track (not shown) when the guide track moves away from the support ear 30, such as when the door is opened in a non-symmetrical position or when unbalanced forces are applied to the door.

Figure 6C:
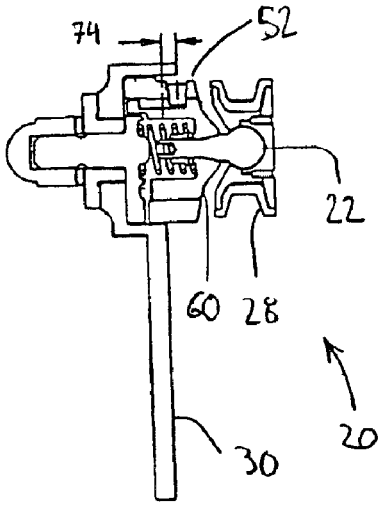
FIG. 6C is a cross-section of an example roller guide of the present invention in its compressed position.

In FIG. 6C, the plunger 60 is shown in its contracted position inside the truck 52. Contraction of the plunger 60 within the truck 52 moves the wheel 28 mounted to the spherically-ended pin 22 closer to the support ear 30 by an inward plunger clearance distance 74.

It will be appreciated that any suitable inward plunger distance 74 and outward plunger clearance distance 72 may be utilized to accommodate the asymmetrical forces and extensions and contractions that are placed upon them by the attached door (not shown) being opened not completely in alignment with the guide tracks. In an example embodiment, the outward plunger clearance distance 72 and inward plunger clearance distance 74 are 0.112 inches.

Figure 6D:
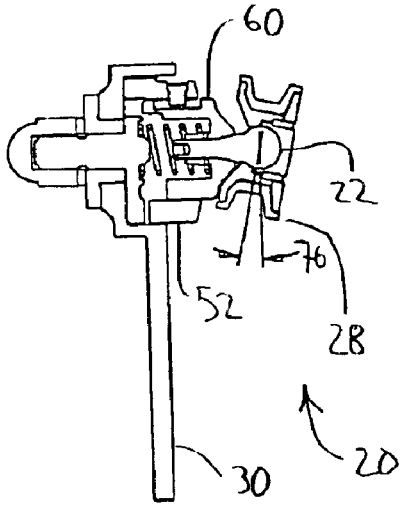
FIG. 6D is a cross-section of an example roller guide of the present invention in its pivoted position.

FIG. 6D shows the pivoting action of the guide 20. The plunger 60 is in its intermediate position with respect to the truck 52. However, the wheel 28 is shown pivoted around the spherically-ended pin 22 by a pivot angle 76. Pivoting of the wheel 28 permits the wheel 28 to follow the track (not shown) without binding or jamming, even when the ear 30 is not in alignment with the track (not shown).

In this example embodiment, the wheel 28 permits approximately a ±12° pivot angle 76 with respect to the ear 30 without binding or jamming against the plunger 60. This permits full 360° rotation of the wheel 28 even as it is pivoted on the pin 22 as it moves along the guide track (not shown).

It will be appreciated that any suitable pivot angle 76 and plunger clearance distances may be utilized to suitably allow the guide to glide along a track without jamming. A larger door with larger spacing between the guides suitably results in greater movement of the guides 20 if the door (not shown) is skewed through the asymmetric opening forces. Thus, in many applications, larger clearances are suitable for larger doors. In an example embodiment, a ±12° pivot angle 76 for the wheel 28, combined with inward plunger clearance 74 and outward plunger clearance 72 of approximately 0.112 inches have been found sufficient for a door approximately two feet square with mechanisms spaced somewhat less than 2 feet apart.

Figure 7A:
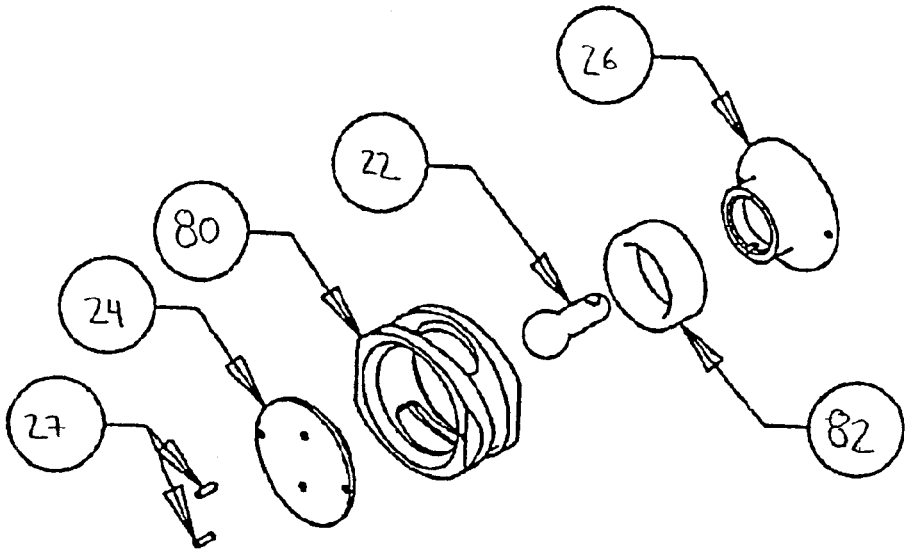
FIG. 7A is an exploded view of an exemplary pivoting slider guide of the present invention.
Figure 7B:
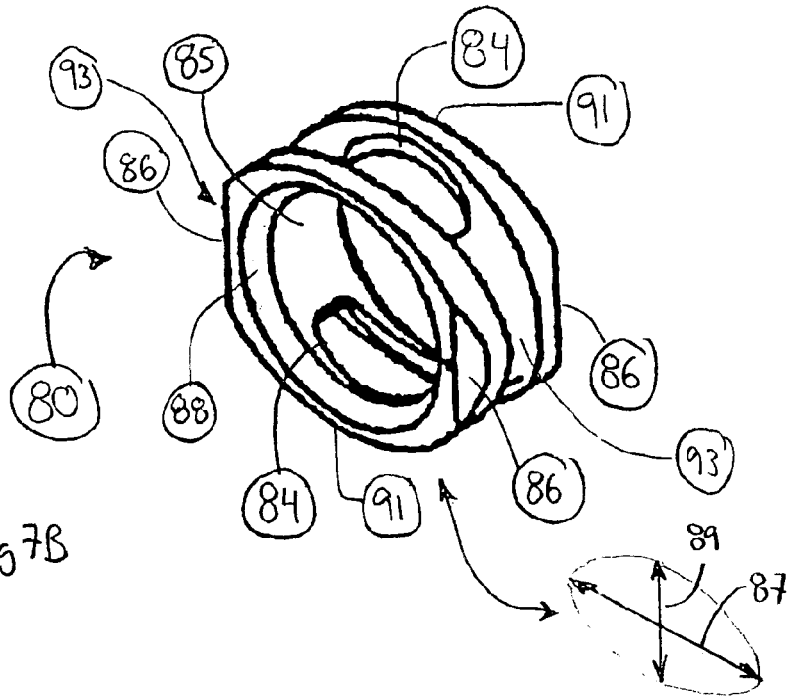
FIG. 7B is an enlarged view of an exemplary slider of the present invention.

FIGS. 7A and 7B show how the present invention may be augmented with a slider 80 to assist the guide (not shown) in bridging track gaps and following curved track. FIG. 7A is an exploded view of a roller mechanism with a roller 82 surrounded and guided by a slider 80. In this example embodiment, the ring-shaped roller 82 closely nests inside a slider 80. The slider 80 is elliptically shaped to stay aligned with the track (not shown) while being tapered and chamfered at its narrow ends to stay in alignment with the track and to bridge track gaps. The roller 82 spins freely inside the slider 80. Both the roller 82 and the slider 80 rotate independently and pivot together and are supported by the male bearing housing 24 and the female bearing housing 26. The male bearing housing 24 and the female bearing housing 26 are threaded into each other holding the roller 82 and slider 80 onto the spherically-ended pin 22. The male bearing housing 24 is threaded into the female bearing housing 26 through the center of the ring-shaped roller 82 and the slider 80 that surrounds the roller 82. The resulting mechanism both pivots and spins around the spherical end of the spherical end pin 22 thereby allowing the slider 80 to follow the track while the inner roller 82 rolls thereby reducing friction allowing the mechanism to freely glide along the track (not shown).

FIG. 7B is an enlarged view of the slider 80. The slider 80 is suitably elliptically-shaped with a cylindrical center opening 85. The center opening 85 fits over and clears the surrounded roller 82 (not shown). The slider 80 has a long direction 87 and a narrow direction 89. The slider 80 slides along the track (not shown) with its long direction 87 aligned with the track. The slider 80 has lateral roller cutaway sections 84 on each side 91 of the narrow direction 89 of the slider 80. The cutaway sections 84 permit the roller 82 within the slider 80 to roll against the track (not shown) while being guided by the slider 80. Lateral cutaway sections 84 are defined one on each side 91 of the slider 80. The cutaway sections 84 penetrate through the slider 80 defining openings through to the center opening 85 allowing the roller 82 (not shown) inside the center opening 85 to bear against the track (not shown) through the slider 80 thereby reducing gliding friction for the guide (not shown). The roller 82 (not shown) is suitably ring shaped to nest within the slider 80 and roll around the male bearing housing 24 and a female bearing housing 26.

As noted above, the narrow ends 93 of the long direction 87 of the elliptically-shaped slider 80 are chamfered. Chamfers 86 narrow the leading and trailing ends 93 of the slider 90 from side to side. The elliptical shape of the slider 80 keeps the slider 80 aligned with its long direction 87 along the track thereby allowing the long direction 87 of the slider 80 to bridge track gaps (not shown). The slider 80 has a bearing bevel 88 on each end of its cylindrical central opening 85 that permits the slider 80 to bear against and yet rotate within the male bearing housing 24 and the female bearing housing 26 (not shown). The male bearing housing 24 and the female bearing housing 26 in turn hold the slider 80 and the encompassed roller (not shown) on the pin 22.

The slider 80 may be constructed of any suitable material that can slide along the track. In an example embodiment, the slider 80 is machined from a segment of elliptical cross-section fiber-filled rod. By way of example and not limitation, alternate sliders 80 may be constructed of nylon or engineering plastic. It will also be appreciated that any suitably shaped elongated slider 80, with or without suitable tapering or champhering, may be used to assist the guide in traversing track gaps.

Figures 8A, 8B:
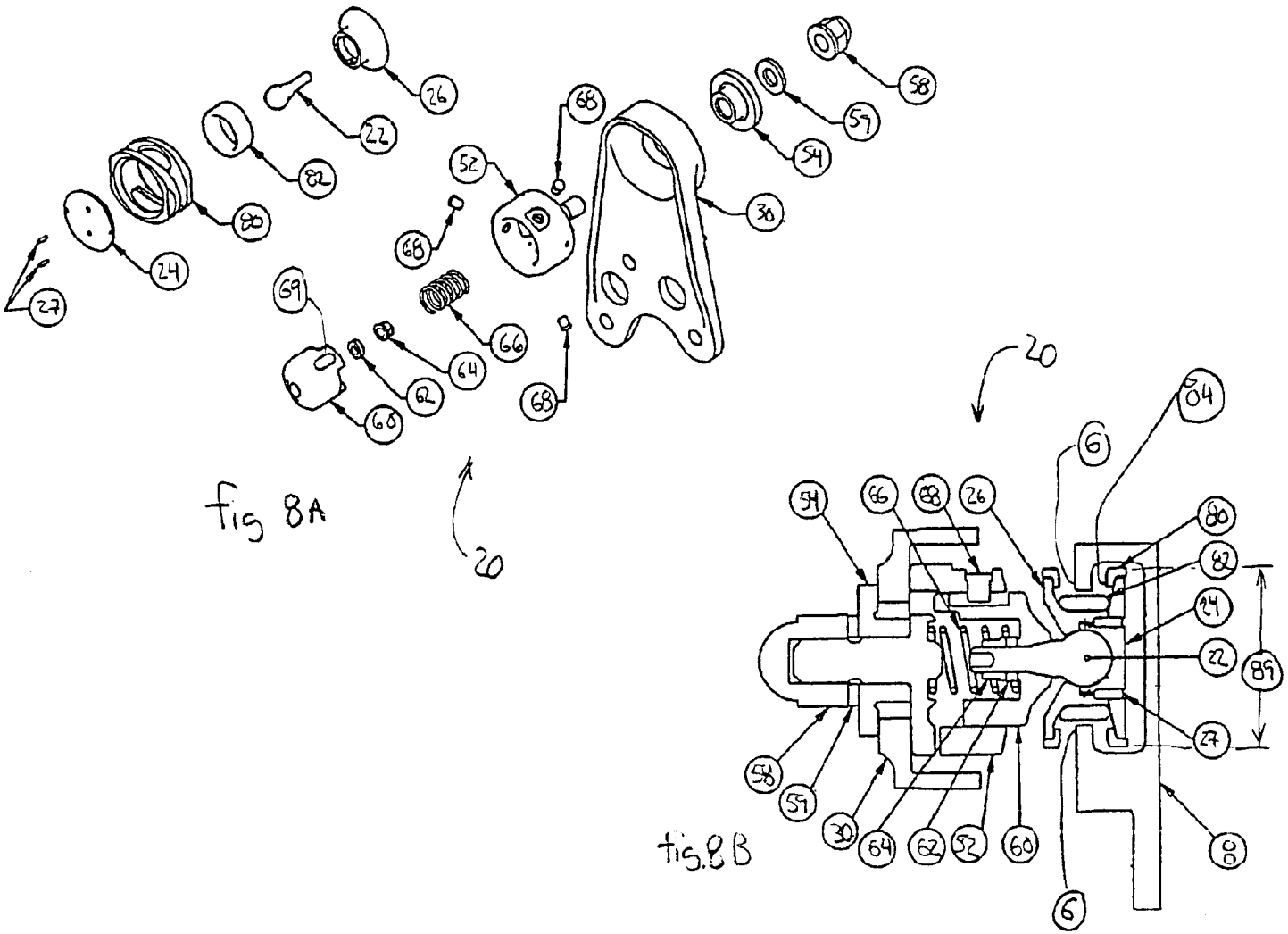
FIG. 8A is an exploded view of an exemplary slider guide of the present invention.
FIG. 8B is a cross-section of an exemplary slider guide of the present invention.

FIG. 8A shows the slider 80 installed in an ear-mounted embodiment of the guide 20. The slider 80 and the roller 82 are held by the male bearing housing 24 and the female bearing housing 26, which are threaded together and locked with locking pins 27 over the pin 22. This permits the slider 80 and the roller 82 to pivot and spin as they follow and roll along the track (not shown). The pin 22 is attached to the plunger 60 with a pin washer 62 and pin nut 64. The plunger is spring-loaded with the spring 66 within the truck 52. The plunger 60 is held within, but permitted to move in and out from, the truck 52. The plunger 60 is held by locking pins 68 that extend through the truck 52 and into the slots 69 in the plunger 60. The truck 52 is held within the support ear 30 and is permitted to slide laterally within the support ear 30 by the slider bushing 54. The truck 52 is held to the slider bushing 54 with the washer 59 and the cap nut 58.

FIG. 8B shows an example guide 20 of the present invention with a slider 80 in cross-section. The slider 80 and roller 82 are held by the male bearing housing 24 and the female bearing housing 26. The male bearing housing 24 and the female bearing housing 26 are threaded together and locked with locking pins 27 around the pin 22. The pin 22 is attached to the plunger 60 with the pin washer 62 and the pin nut 64. The plunger 60 is spring-loaded with respect to the surrounding truck 52 with the spring 66. The plunger 60 is held within, but able to move in and out from, the truck 52 by the retainer pins 68 that extend through the truck 52 into slots 69 in the plunger 60. It will be appreciated that any suitable retaining method may be utilized to hold the plunger 60 within the truck 52 that still allows the plunger 60 to move in and out. The truck 52 is attached to the slider bushing 54 through the support ear 30 with the washer 59 and the cap nut 58.

The slider 80 is shown in cross-section through its narrow direction 89 inside a C-shaped guide track 8. The tips 6 of the C-shape of the track 8 fit through cutaway sections 84 in the narrow direction 89 of the slider 80 to roll against the roller 82 while the guide 20 is guided along the track by the slider 80.

Figure 9:
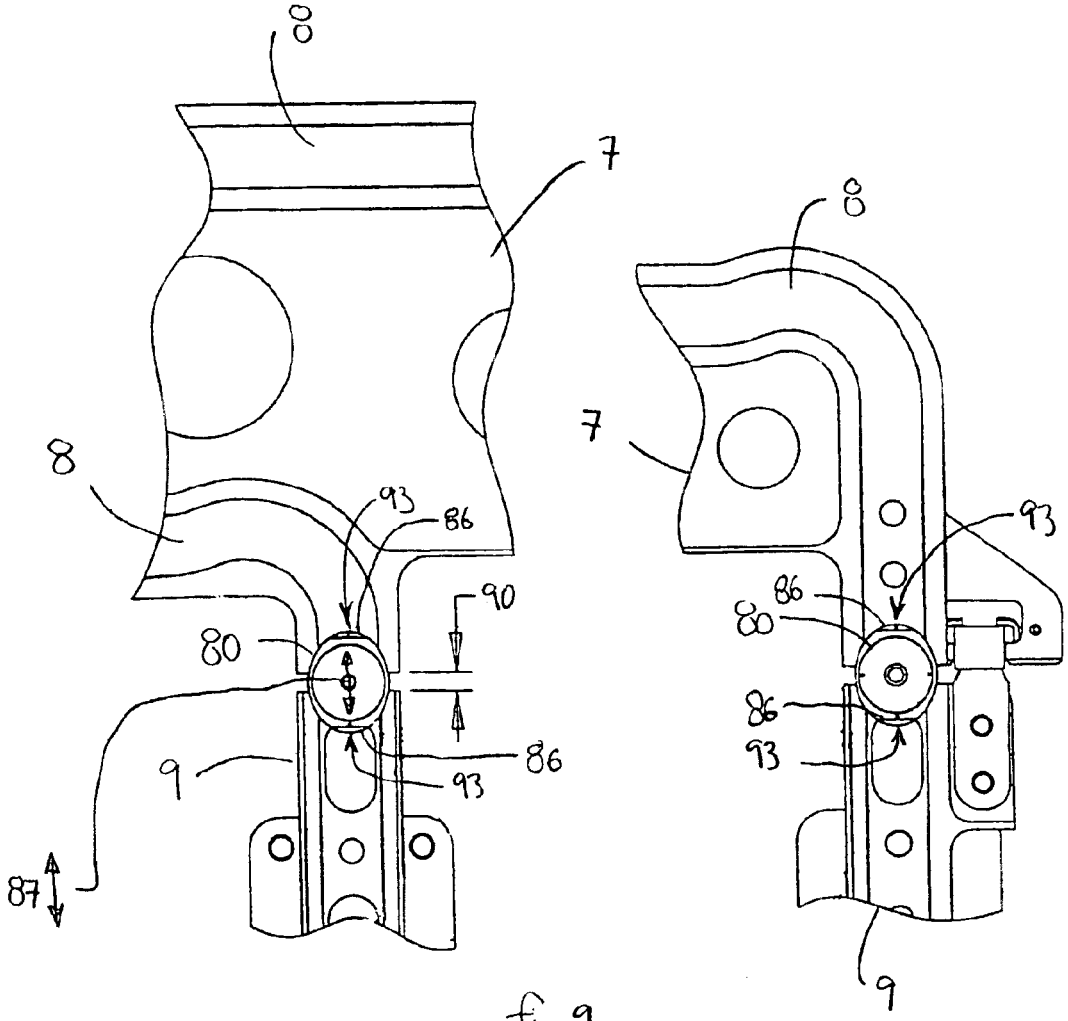
FIG. 9 is a side view of an exemplary slider guide of the present invention traversing a track gap.

FIG. 9 is a side view of the slider mechanism showing how the slider 80 assists the present invention in bridging a track gap 90. The elliptical-shaped slider 80 moves along the track with its long direction 87 aligned with the track 8 and 9. This permits the narrow ends 93 of the slider with the chamfers 86 to assist the slider 80 in crossing misalignments and gaps in the guide track 8. In the example shown in FIG. 9, the guide track 8 is attached to a folding track support 7, as shown in FIG. 1A. The folding track support 7 results in a track gap 90 between the folding track guide 8 and a fixed portion of the track 9 mounted to the fuselage of the aircraft (not shown). The elliptical slider 80 surrounds the roller ring (not shown) while being flexibly held to the door through plunging, pivoting and rotating mechanisms of the guide of the present invention (not shown). This permits the door to traverse a complicated shaped track with gaps, such as that shown in FIG. 9, without jamming, even under asymmetrical loads. In an example embodiment, a track gap 90 of up to around 0.25 inches may be bridged by a guide with a slider 80 of approximately 1.5 inches along its long direction 87. It will also be appreciated that the guide of the present invention suitably bridges track gaps of approximately 0.1 inch without the use of the slider 80 when a wheel of approximately 1 inch is utilized. Thus, the slider 80 is suitably not utilized in all applications with track gaps.

It will be appreciated that the guide of the present invention may be utilized in various combinations with alternate roller or slide mechanisms when multiple guide mechanisms are utilized to guide a door or other object being translated along a track. In one embodiment, an aircraft door such as that shown in FIG. 1B is translated along a track utilizing two ear-mounted guides 20 such as that shown in FIG. 4 and one pedestal-mounted roller 100 as shown in FIGS. 10A and 10B.

Figure 10B:
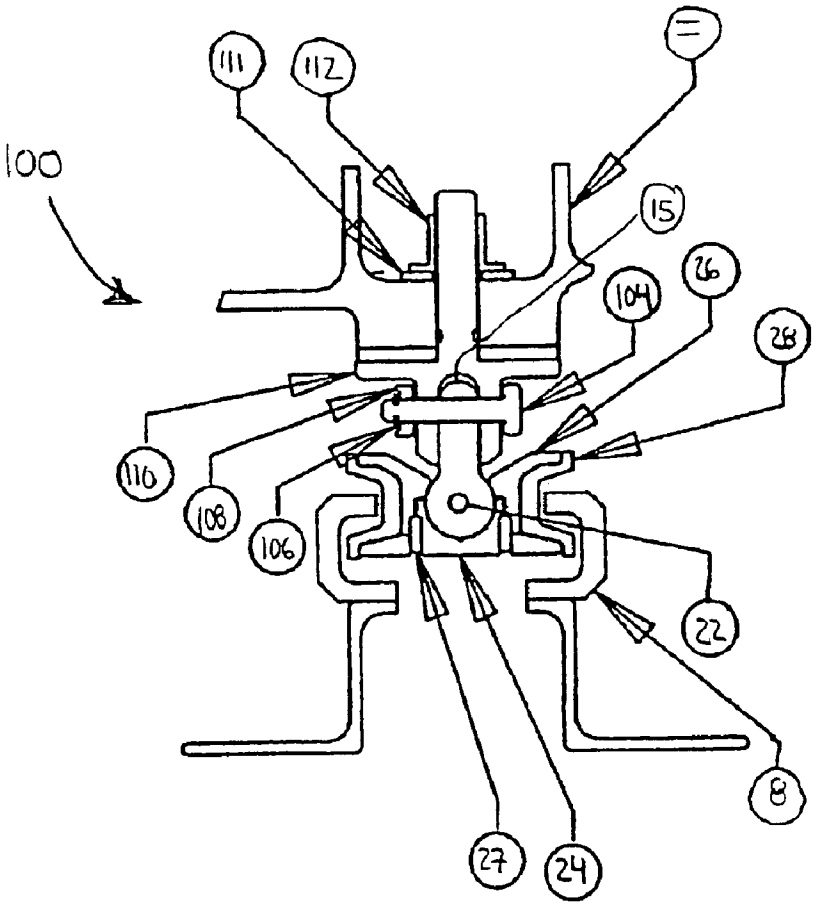
FIG. 10B is a cross-section of an exemplary pedestal guide of the present invention.
Figure 10A:
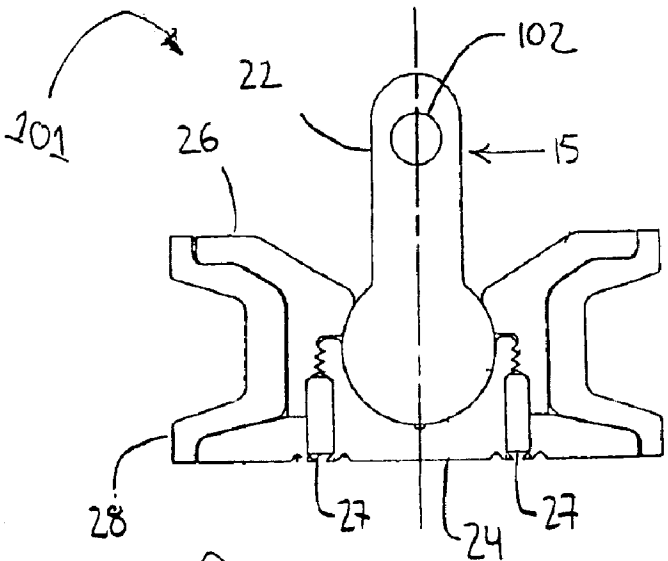
FIG. 10A is a cross-section of an exemplary pivoting roller for a pedestal guide of the present invention.

FIG. 10A shows an alternate pivoting wheel mount 101 for a wheel 28. A wheel 28 is attached to a spherically-headed pin 22 thereby permitting the wheel 28 to pivot as well as spin around the pin 22, in the same manner as described above. In this exemplary embodiment, the wheel 28 is held in place on the pin 22 by the male housing bearing 24 and the female housing bearing 26, which are threaded together and locked together with retaining pins 27. In this embodiment, the connection end 15 of the spherically-headed pin 22 is not threaded, but instead has a pin hole 102 that permits the pin 22, with the attached pivoting and rotating wheel 28, to be cotter-pinned to a pedestal (not shown).

FIG. 10B is an exemplary embodiment of a pedestal roller 100 of the present invention. In this cross-section, a wheel 28 is held within the male housing bearing 24 and the female housing bearing 26 around the pin 22. The female housing bearing 26 has a conical depression that rests over a pedestal 110 that is cone-shaped, thereby permitting the wheel 28 to pivot and roll around on the pin 22 without binding. The pin 22 is held within the pedestal 110 with a cotter pin 104 through the connection end 15 of the pin 22. The cotter pin 104 is held in place with a lock clip 106 over a retaining pin washer 108. The pedestal 110 is bolted to the door 11 with a pedestal washer 111 and a pedestal nut 112. Attaching the spherical pin 22 to the pedestal with the cotter pin 104 permits the pedestal 110 to be securely bolted to the door 11 with the nut 112 on the inside of the door 11 while still allowing the wheel 28 to be removably attached to the pedestal 110 with the cotter pin 104. In this embodiment, the wheel 28 may pivot around the spherically-headed pin 22 an angle of approximately ±12° without binding against the pedestal 110, which is cone-shaped to clear the female bearing housing 26 that holds the wheel 28. This embodiment of the guide of the present invention allows the wheel 28 to pivot and spin as it rides along the guide track 8. This version of the guide 100 does not include the plunger mechanism or slider mechanism of the ear-mounted guide 20 described above. It will be appreciated that any suitable combination of pedestal-mounted pivoting wheels and slider plunger-mounted pivoting wheels may be utilized on any given door or object to be translated along a track in a manner that does not jam or bind when asymmetric forces or displacements are applied to the object or door. It will also be appreciated that the pedestal-mounted pin 22 is suitably combined with either a slider or a plunger, depending upon degrees of freedom desired for the guide mechanism in a particular application. Further, it will be appreciated that any one or more of the guide mechanisms suitably may have an attached slider to bridge and track gaps and imperfections. It will also be appreciated that the guide mechanisms of the present invention need not be mounted on a support ear, but may be mounted directly to other suitable openings or connections on the door or other object to be translated along the guide track.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A system for guiding movement of an object along a track, the system comprising:

an ear attached to an object to be guided along a track, the ear defining an opening therein;

a bushing positioned in the opening, the bushing being laterally movable within the opening;

a truck attached to the bushing;

a plunger held within the truck, the plunger being urgingly movable within the truck, the plunger being further arranged to move in and out from the truck;

a pivot attached to the plunger, the pivot defining a pivot point; and a roller attached to the pivot, the roller being arranged to pivot and rotate around the pivot point, the roller being movable along the track.

2. The system of claim 1 further comprising a slider attached to the pivot, the slider being arranged to slide along the track the slider being further arranged to guide the roller along the track.

3. The system of claim 2, wherein the slider includes at least one notch to mate with the track.

4. The system of claim 2, wherein the slider surrounds the roller, the slider further defining at least one second opening to permit the roller to roll along the track.

5. A door assembly that is movable along a track, the assembly comprising:

a door;

at least two first guides attached to the door, the first guides each including:

an attachment member attached to the door, the member defining an opening therein;

a bushing positioned in the opening, the bushing being laterally moveable within the opening;

a plunger attached to the bushing, the plunger being configured to move towards and away from the bushing; and a first guide mechanism pivotably attached to the plunger, the first guide mechanism being movable along the track; and at least one second guide attached to the door, the second guide including:

a pedestal attached to the door, the pedestal being arranged to extend from the door; and a second guide mechanism pivotably attached to the pedestal, the second guide mechanism being movable along the track.

6. The assembly of claim 5, wherein at least one of the first guide mechanisms and the second guide mechanism includes a wheel, the wheel being arranged to roll along the track.

7. The assembly of claim 5, wherein at least one of the first guide mechanisms and the second guide mechanism includes a slider, the slider being arranged to slide along the track.

8. The assembly of claim 5, wherein the at least one of the first guide mechanism and the second guide mechanism includes a roller and a slider, the roller being arranged to roll along the track guided by the slider.

9. A system for guiding movement along a track, the system comprising:

at least one first guide attached to an object to be moved along a track, the first guide including:

an attachment member attached to the object, the member defining an opening therein;

a bushing positioned in the opening, the bushing being laterally moveable within the opening;

a plunger attached to the bushing, the plunger being configured to move towards and away from the bushing; and a first guide mechanism pivotably attached to the plunger, the first guide mechanism being movable along the track; and at least one second guide attached to the object, the second guide including:

a pedestal attached to the object, the pedestal being arranged to extend from the object; and a second guide mechanism pivotably attached to the pedestal, the second guide mechanism being movable along the track.

10. The system of claim 9, wherein at least one of the first guide mechanism and the second guide mechanism includes a wheel, the wheel being arranged to roll along the track.

11. The system of claim 9, wherein at least one of the first guide mechanism and the second guide mechanism includes a slider, the slider being arranged to slide along the track.

12. The system of claim 9, wherein the at least one of the first guide mechanism and the second guide mechanism includes a roller and a slide, the roller being arranged to roll along the track guided by the slider.

13. An apparatus for guiding movement of an object along a track, the apparatus comprising:

an attachment member attached to an object to be moved along a track, the member defining an opening therein;

a bushing positioned in the opening, the bushing being laterally moveable within the opening;

a plunger attached to the bushing, the plunger being configured to move towards and away from the bushing;

a guide mechanism pivotably attached to the plunger, the guide mechanism being movable along the track.

14. The system of claim 13, wherein the guide mechanism includes a wheel, the wheel being arranged to roll along the track.

15. The system of claim 13, wherein the guide mechanism includes a slider, the slider being arranged to slide along the track.

16. The system of claim 15, wherein the guide mechanism further includes a roller, the roller being arranged to roll along the track, the slider being arranged to guide the roller along the track.

17. The system of claim 13, wherein the plunger includes a spring, the spring being arranged to bias the plunger with respect to the bushing.

18. A method for guiding an object along a track, the method comprising:

attaching a plunger to an object to be guided along a track, the plunger having a first end attached to the object and a second end;

sliding the first end of the plunger laterally with respect to the object;

plunging the second end of the plunger towards and away from the object;

attaching a guide mechanism to the second end of the plunger;

pivoting the guide mechanism; and moving the guide mechanism along the track to guide the object.

19. The method of claim 18, wherein moving the guide mechanism includes rolling.

20. The method of claim 19, further comprising directing the guide mechanism along the track with a slider.

* * * * *